US005570721A

United States Patent [19]

Funke et al.

[11] Patent Number: 5,570,721

[45] Date of Patent: Nov. 5, 1996

[54] DOUBLE ACTING SOLENOID AND POPPET VALVE SERVOMECHANISM

[75] Inventors: Steven J. Funke, Peoria, Ill.; Craig W. Lohmann, Denver, Iowa; Dennis D. Feucht, Morton, Ill.

[73] Assignee: Caterpillar Inc., Peoria, Ill.

[21] Appl. No.: 412,746

[22] Filed: Mar. 29, 1995

[51] Int. Cl.[6] ..... F15B 13/044

[52] U.S. Cl. ..... 137/625.65; 137/625.27; 251/129.1

[58] Field of Search ..... 137/625.27, 625.65; 251/129.1

[56] References Cited

U.S. PATENT DOCUMENTS

| | | | |
|---|---|---|---|
| 3,447,776 | 6/1969 | Blumer | 251/65 |
| 3,548,877 | 12/1970 | Aumayer | 137/625.65 |
| 4,361,309 | 11/1982 | Sogabe | 251/137 |
| 4,392,612 | 7/1983 | Deckard et al. | 239/88 |
| 4,512,549 | 4/1985 | Gast et al. | 251/137 |
| 4,649,803 | 3/1987 | Abel | 91/417 R |
| 4,783,047 | 11/1988 | Baltus et al. | 251/129.1 |
| 4,948,093 | 8/1990 | Sugawara et al. | 251/129.15 |
| 4,974,495 | 12/1990 | Richeson, Jr. | 91/459 |
| 5,108,070 | 4/1992 | Tominaga | 251/65 |
| 5,131,624 | 7/1992 | Kreuter et al. | 251/129.18 |
| 5,199,392 | 4/1993 | Kreuter et al. | 123/90.11 |

*Primary Examiner*—Gerald A. Michalsky
*Attorney, Agent, or Firm*—Marshall O'Toole; Gerstein Murray & Borun

[57] ABSTRACT

A fluid pressure control valve includes a double acting solenoid and a poppet valve seatable against two opposite valve seats. The respective solenoids are momentarily operated to move the poppet valve into respective valve seat positions. Solenoid actuation is terminated when the poppet valve reaches the valve seat position. The poppet valve is maintained against one of the valve seats by a spring force. A hydraulic force maintains the poppet valve against the opposite valve seat. One valve seat has a larger diameter than the other so that the hydraulic force against the poppet valve in one seat position develops a larger force than the spring force, whereas in the opposite valve seating position, the spring force is greater than the developed hydraulic force.

4 Claims, 1 Drawing Sheet

DOUBLE ACTING SOLENOID AND POPPET VALVE SERVOMECHANISM

TECHNICAL FIELD

The present invention relates generally to fluid control valves and, more particularly, to electronically-actuated fluid pressure control valves suitable for fuel injection systems and/or hydraulic engine valve actuation systems.

BACKGROUND ART

Electronically-actuated fluid pressure valves may be used for actuating engine valves as well as for fuel injection purposes.

An example of an electronically-actuated pressure control valve and an electrically-controlled unit fuel injector is shown in U.S. Pat. No. 4,392,612 issued to Deckard, et al. on Jul. 12, 1983. In Deckard, et al. the injector includes a mechanically-actuated fuel pumping plunger and an electrically-actuated fuel pressure control valve assembly. The pressure control valve assembly includes a solenoid-operated poppet valve that controls fuel pressure in the unit injector in order to control fuel injection delivery. Fuel pressure is controllably enabled to be developed in the injector by electrical actuation of the pressure control valve assembly. Fuel pressure is controllably prevented from developing within the injector by not electrically-actuating the pressure control valve assembly.

In such electronically-controlled unit injectors, the armature of the pressure control valve assembly moves the poppet valve in one direction until it engages a valve seat and holds the poppet valve in the fuel sealing position to enable fuel pressure to be developed in the unit injector, eventually resulting in fuel injection. At the end of the fuel injection cycle, a solenoid is electrically deenergized and a return spring backs the poppet valve off of the valve seat and returns the poppet valve to the valve open position which prevents the development of fuel pressure by spilling the fuel back to the fuel reservoir.

Other proposed electronically-controlled unit injectors and fuel injector systems incorporate an electrically-actuated control valve assembly having two solenoids for moving the poppet valve in respective directions and for latching the valve in the respective open and closed positions. Accordingly, many of the currently proposed control valve devices require high voltage electronics in a solid state motor and amplifier configuration or require bi-directional electronics for the actuating and latching solenoids.

Accordingly, it is desired to reduce the cost of currently proposed electronically-controlled unit injectors and fuel injector systems and/or hydraulically actuated engine valve systems using electrically-actuated control valves as well as to reduce the required number of electronic components for such current systems.

DISCLOSURE OF THE INVENTION

An electronically-actuated pressure control valve assembly is provided with a poppet valve and two electrically-actuated solenoids to move the poppet valve in respective directions towards opposite valve seats. The poppet valve actuating solenoids are only operated for a brief interval sufficient to move the poppet until it reaches one of the valve seats.

The two opposite valve seats cooperate with respective seating portions on the poppet valve. Actuating a respective solenoid moves one of the poppet valve sealing portions into sealing engagement with one of the valve seats. Spring means are provided to maintain the respective poppet valve sealing portion seated against one of the valve seats. Hydraulic force means are provided to be greater than the spring force so as to maintain the respective poppet valve sealing portion seated against the other valve seat in the opposite seating position.

With the poppet valve in the initial seating position maintained by the spring means, a differential force configuration is provided wherein the spring force is greater than the hydraulic force. The valve seat associated with the spring means is adapted to be smaller than the opposite, larger valve seat associated with the hydraulic force. Thus, the spring force is greater than the hydraulic force when the poppet valve is maintained against the smaller valve seat associated with the spring. On the other hand, when the poppet valve has been moved by the solenoid to the opposite, larger valve seat associated with the hydraulic force, the hydraulic force acting against the larger valve seat is now greater than the spring force so as to maintain the poppet valve in seated position.

In one aspect of the present invention an electronically-actuated pressure control valve assembly for a fuel injector includes a valve body with a high pressure fluid inlet port, a fluid outlet port and an intermediate fluid port. A first valve seat communicates with the high pressure fluid inlet and the intermediate fluid port. A second valve seat communicates with the intermediate fluid port and the fluid outlet port. A poppet valve is slidably mounted in the valve body and includes respective sealing portions sealingly engageable with the first and second valve seats.

A pair of solenoids are adapted for respectively moving the poppet valve into sealable engagement with the opposite valve seats. The first valve seat is adapted to be smaller than the second valve seat. When the poppet valve seat is seated against the first valve seat, the spring force is larger than the hydraulic force on the poppet valve so that the poppet valve is maintained against the first valve seat. When the poppet valve is seated against the second valve seat, the hydraulic force acting on the poppet is now greater than the spring force so that the poppet is maintained against the second valve seat.

Accordingly, the present invention requires that the solenoid actuators only need to be operated for a short interval necessary to move the poppet valve from one valve seat to the opposite valve seat. Once the poppet valve is seated against a valve seat, it is maintained in position by the spring means in one seating position and by the hydraulic force in the opposite seating position. Therefore, no high voltage electronics with a solid state motor or bi-directional electronics are required for latching the solenoids.

Also, a significant advantage of the present invention is that very short current on-times are required to operate the solenoid actuators thereby lowering the actuation power requirements. The lower power requirements offers a significant advantage of the present invention in enabling multiplexing so as to reduce the number of electronic drivers required to operate the unit injectors in current fuel injector systems and/or hydraulically actuated engine valve systems.

BEST MODE FOR CARRYING OUT THE INVENTION

Figure 1:
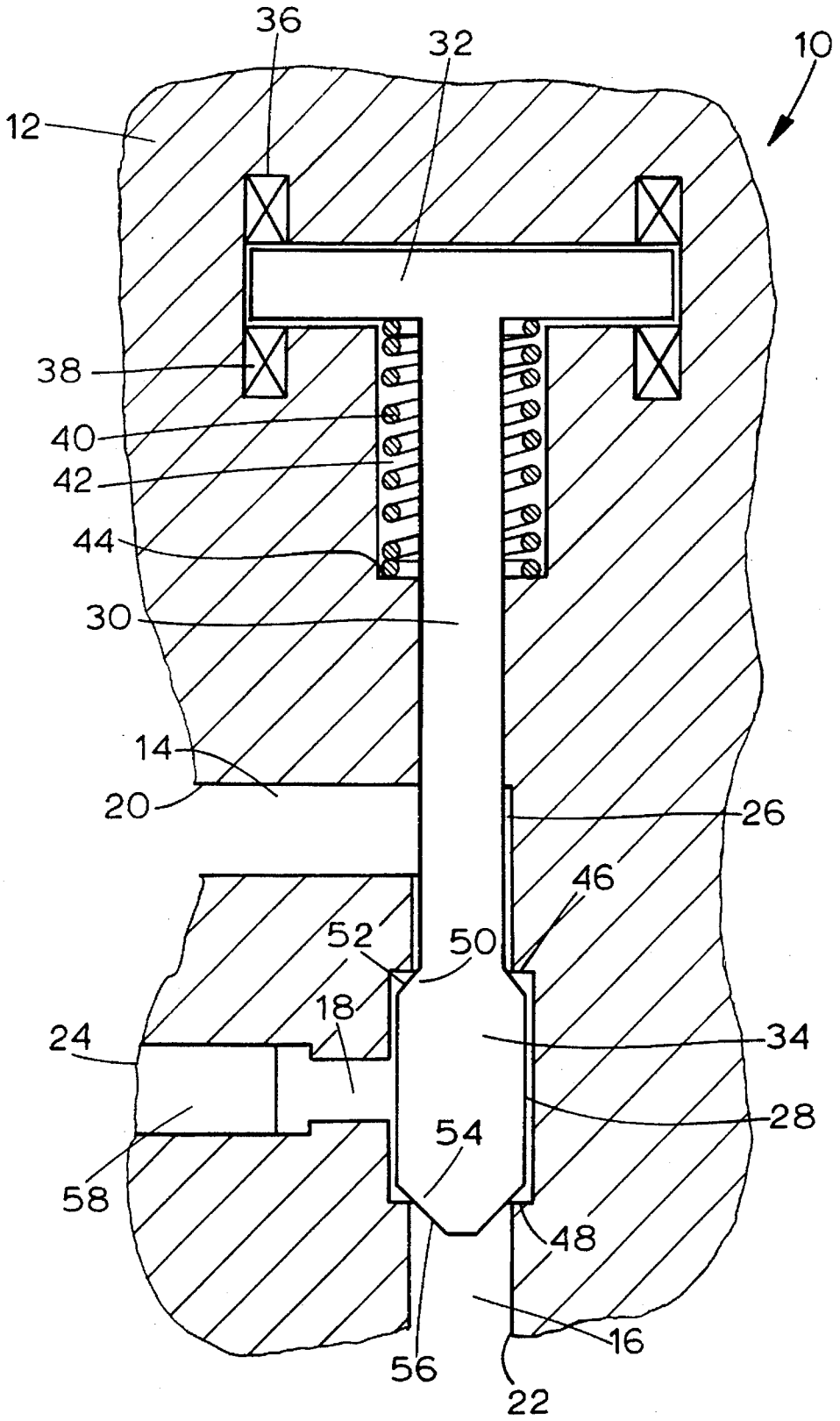
FIG. 1 is a schematic diagram illustrating a fluid pressure control valve assembly in accordance with the present invention.

Referring to the drawings, there is illustrated a fluid pressure control valve 10 which may be utilized in electronically-controlled fuel injector systems. Fluid valve 10 includes a valve body 12 with respective passageways 14, 16, 18 to accommodate a high pressure fluid inlet 20, a fluid outlet 22, and an intermediate fluid port 24. Each of the valve body passageways 14, 16, 18 communicate with a cylindrical valve body chamber 26 which ends in a lower, wider valve body chamber 28. A poppet valve 30 is adapted to be slidably mounted within the cylindrical chamber 26 and includes an upper armature 32 and a lower plug 34.

Above the valve armature 32 there is provided an upper solenoid 36, while below the armature 32 there is provided a lower solenoid 38. A spring 40 is suitably mounted within a cavity 42 in the valve body 12 so that one end of the spring 40 rests on a shoulder 44 while the other spring end abuts against the bottom of the valve armature 32 so that the poppet 30 is maintained in an up position by the spring force.

The valve body 12 includes an upper valve seat 46 and a lower valve seat 48 at respective opposite ends of the chamber 28. An upper valve plug seating portion 50 includes a slanted sealing surface 52 for sealably engaging with the upper valve seat 46. Similarly, a lower valve plug portion 54 includes a slanted seating surface 56 for seatably engaging with the lower valve seat 48. The lower valve seat 48 is made slightly larger than the upper valve seat 46. As an example, with the poppet valve 30 diameter of 3.0 mm the diameter of the upper valve seat 46 is 3.5 mm, while the diameter of the lower valve seat 48 is 3.9 mm. Also, the diameter of lower chamber 28 is 5.0 mm and the diameter of the valve plug 34 is 4.5 mm.

It is to be understood that the dimensioning of the illustrated components is such that the poppet valve 30 travels only a very small distance between the seating engagement of the slanted sealing surface 52 with the upper valve seat 46 in the topmost position and in the opposite direction with the slanted sealing surface 56 in sealing engagement with the lower valve seat 48. This movement of the poppet valve may be no more than 0.1–0.2 mm travel distance.

The high pressure fluid inlet 20 may be connected to a source of high fluid pressure such as 3,228 psi and the fluid outlet 22 can be connected to the system engine crank case. The intermediate fluid port 24 can include a plunger 58 slidably mounted within an extension of the passageway 18 so that movement of the plunger 58 can actuate a spool valve or other devices to control fuel injection and/or engine valve actuation.

With the topmost position shown in FIG. 1, wherein the slanted sealing surface 52 is engaged against the upper valve seat 46, the upper valve seat is closed and the lower valve seat is opened. High fluid pressure from port 20 and via passageways 14 and the cylindrical chamber 26 is exerted onto the poppet valve 30 at the closed upper valve seat 46, but this hydraulic force is adapted to be less than the force of spring 40 which holds the poppet in the upper position. When the poppet valve 30 is moved to the lower position with the slanted sealing surface 56 engaged against the lower valve seat 48, the upper valve seat is open so that the high fluid pressure is communicated through the cylindrical chamber 26 into the lower chamber 28 and onto the poppet valve against the lower seat. The lower seat is arranged to be larger than the upper seat so that the hydraulic force on the poppet valve at the lower valve seat is now greater than the force from spring 40 so that the poppet valve is maintained in its lowermost position with the lower seat closed. Since the lower seat is closed, the high pressure fluid at the inlet 20 is coupled through the opened upper valve seat and into the passageway 28 to actuate the plunger 58.

INDUSTRIAL APPLICABILITY

The fluid pressure control valve 10 described herein can be used as a unit actuator in a fuel injection system and/or hydraulic engine valve actuation system. For example, the operation of the upper and lower solenoids 36, 38 can be synchronized and operated in response to an engine control module (ECM). With suitable control signals from the ECM, to the lower solenoid 38, solenoid 38 can be momentarily operated to attract the valve armature 32 and move the poppet valve 30 downwardly (overcoming the spring force) until the slanted sealing surface 56 is seated against the lower valve seat 48. With the poppet valve 30 on the lower valve seat, the hydraulic force acting down on the poppet is greater than the spring force acting upwardly. This difference in force holds the poppet valve 30 against the lower seat without actuation of the solenoid 38. As described previously, the downward hydraulic force is larger on the lower seat due to the difference in seat diameters.

When the poppet valve is on the lower seat, the high pressure fluid at the fluid inlet 20 is coupled through the opened upper valve seat to the plunger 58 which can move a spool valve for eventually actuating the fuel injection cycle and/or engine valve actuation cycle. The poppet valve 30 is maintained in the lowermost position by the hydraulic force so that the lower solenoid 38 needs only to be operated momentarily. Thus, solenoid operating current only needs to move the poppet valve down to the lower valve seat position and then the solenoid operating current can be terminated. This significantly reduces the amount of electrical power required to operate the poppet valve actuating mechanism, particularly since there is no additional electronic latching required to maintain the poppet valve in the lowermost position.

To return the poppet valve to the topmost position, the upper solenoid 36 responds to a synchronized signal from the ECM supplying sufficient operating current to overcome the hydraulic force and move the poppet valve to the topmost position where the slanted sealing surface 52 is now engaged with the upper valve seat 46 and the lower valve seat is opened. Operating current to the upper solenoid 36 is only momentarily supplied and can be terminated because the poppet valve 30 is maintained in the topmost position by the spring 40. Also it must be noted that the configuration of the valve components is arranged such that the high pressure fluid at inlet 20 acting on the smaller upper valve seat develops a smaller hydraulic force attempting to move the poppet valve 30 in a downward direction, which is less than the spring force maintaining the poppet valve in the topmost position.

With the poppet valve 30 in the topmost position and the upper valve seat closed, the fluid in the passageway 18 flows back into the lower chamber 28 to exit through the opened lower valve seat and into the passageway 16 to be dumped into the engine crank case. Thus, the plunger 58 is vented to the crank case which allows the spool valve to return and thereby completing the fuel injection cycle and/or engine valve actuation cycle.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A fluid pressure control valve comprising:

a valve body with a fluid inlet port, a fluid outlet port, and an intermediate fluid port;

a first valve seat communicating with said fluid inlet and said intermediate fluid ports;

a second valve seat communicating with said intermediate fluid port and said fluid outlet port;

a popper valve slidably mounted in said valve body having an actuating end and an opposite fluid sealing end, said popper valve fluid sealing end including a first sealing portion sealably engageable with said first valve seat to open and close said first valve seat, and a second sealing portion sealably engageable with said second valve seat to open and close said second valve seat;

an electrical actuator adapted for mounting at said popper valve actuating end and momentarily operably energized for moving said popper valve into respective sealing engagement with said first and second valve seats;

spring means coupled to said popper valve and providing a spring force for maintaining said popper valve first sealing portion sealably engaged with said first valve seat when said electrical actuator is not energized; and fluid pressure means coupled to said popper valve and providing respective first and second hydraulic forces, said second hydraulic force maintaining said popper valve second sealing portion sealably engaged with said second valve seat when said electrical actuator is not energized, said second hydraulic force being larger than said spring force with said popper valve engaging said second valve seat and wherein said second valve seat is larger than said first valve seat to enable said second hydraulic force to exceed said spring force when said popper valve engages said second valve seat and said spring force to exceed said first hydraulic force when said popper valve engages said first valve seat.

2. A fluid pressure control valve according to claim 1, wherein said electrical actuator includes a pair of solenoids for respectively moving said poppet valve.

3. A fluid pressure control valve according to claim 2, wherein one of said solenoids is momentarily operably energized to move said poppet valve in a first direction into sealing engagement with said first valve seat, and the other of said solenoids is momentarily operably energized to move said poppet valve in an opposite second direction into sealing engagement with said second valve seat.

4. A fluid pressure control valve according to claim 1, wherein said fluid inlet port is coupled to a high pressure fluid source.

* * * * *

UNITED STATES PATENT AND TRADEMARK OFFICE

CERTIFICATE OF CORRECTION

PATENT NO. : 5,570,721

DATED : November 5, 1996

INVENTOR(S) : Steven J. Funke, et. al.

It is certified that error appears in the above-indentified patent and that said Letters Patent is hereby corrected as shown below:

Columns 5 and 6, in claim 1 throughout, the word "popper" should be--poppet--.

Signed and Sealed this

Eighth Day of April, 1997

Bruce Lehman

*Attest:*

BRUCE LEHMAN

*Attesting Officer*

*Commissioner of Patents and Trademarks*